US012369701B1

(12) United States Patent
Fisher, II et al.

(10) Patent No.: US 12,369,701 B1
(45) Date of Patent: Jul. 29, 2025

(54) COSMETIC APPLICATOR HAVING A SEALABLE CAP

(71) Applicant: CRYSTAL INTERNATIONAL (GROUP), INC., Scarborough (CA)

(72) Inventors: Stephen M. Fisher, II, Sherman, CT (US); William Lloyd Alusitz, Yorktown Heights, NY (US)

(73) Assignee: CRYSTAL INTERNATIONAL (GROUP), INC., Scarborough (CA)

( * ) Notice: Subject to any disclaimer, the term of this patent is extended or adjusted under 35 U.S.C. 154(b) by 0 days.

(21) Appl. No.: 18/427,497

(22) Filed: Jan. 30, 2024

(51) Int. Cl.
*A45D 40/26* (2006.01)
*A46B 17/04* (2006.01)
*A45D 40/00* (2006.01)

(52) U.S. Cl.
CPC ..... *A45D 40/26* (2013.01); *A45D 40/262* (2013.01); *A46B 17/04* (2013.01); *A45D 2040/0018* (2013.01); *A45D 2200/1009* (2013.01); *A46B 2200/1046* (2013.01)

(58) Field of Classification Search
CPC ..... A45D 40/26; A45D 40/262; A45D 2040/0018; A45D 2200/1009; A46B 17/04; A46B 2200/1046
See application file for complete search history.

(56) References Cited

U.S. PATENT DOCUMENTS

| | | | | |
|---|---|---|---|---|
| 7,618,208 | B2 | 11/2009 | Baines et al. | |
| 9,796,510 | B2 | 10/2017 | Hagen | |
| 10,213,005 | B2 * | 2/2019 | Vanoncini | A45D 40/26 |
| 10,759,559 | B2 | 9/2020 | Kraft et al. | |
| 2020/0138170 | A1 | 5/2020 | Maurin et al. | |
| 2020/0331663 | A1 | 10/2020 | Edie et al. | |
| 2023/0052434 | A1 | 2/2023 | Bertram et al. | |

FOREIGN PATENT DOCUMENTS

| | | | |
|---|---|---|---|
| CN | 110037429 | A | 7/2019 |
| CN | 212233516 | U | 12/2020 |
| CN | 213849201 | U | 8/2021 |
| FR | 3122862 | B1 | 5/2023 |
| KR | 101720298 | B1 | 4/2017 |
| KR | 101920160 | B1 | 2/2019 |
| KR | 20220001357 | U | 6/2022 |
| WO | 2021154036 | A1 | 8/2021 |

OTHER PUBLICATIONS

International Search Report and Written Opinion for Application No. PCT/US2025/013860 dated May 7, 2025.

* cited by examiner

*Primary Examiner* — Jennifer C Chiang
(74) *Attorney, Agent, or Firm* — Patterson + Sheridan, LLP

(57) ABSTRACT

A cosmetic applicator includes a container configured to accommodate a cosmetic product. The cosmetic applicator includes a cap removably coupled to the container. An end of the container or the cap is configured to apply and/or allow access to the cosmetic product. The cosmetic applicator includes a seal radially compressed between the cap and the container. The cosmetic applicator includes a mechanical advantage device having a first portion disposed on the cap and a second portion disposed on the container. The mechanical advantage device is operable to advance a retaining feature attached to the cap or the container across the seal.

21 Claims, 8 Drawing Sheets

COSMETIC APPLICATOR HAVING A SEALABLE CAP

BACKGROUND

Field of the Invention

The present disclosure relates to a cosmetic applicator having a container and a sealable cap that is rotatable to traverse a retaining feature (e.g., projection) attached to the cap or the container across a seal disposed between the cap and a container of the cosmetic applicator.

Description of the Related Art

Cosmetic applicators include a container configured to store a cosmetic product (e.g., lip gloss, mascara, lip liner, concealer, foundation, eye shadow, eyeliner etc.) that may be applied to an individual using an applicator (e.g., sponge, brush, etc.) thereof. To prevent the cosmetic agent from drying out or transferring the agent unintended to objects and surfaces, cosmetic applicators include a cap that may be removably coupled to the container. The cap may require the individual to pull the cap with substantial force to decouple the cap from the container. In some instances, the force required to decouple the cap from the container may, in some instances, cause the cosmetic agent to spill onto the user.

Accordingly, there is a need for a cosmetic applicator having a cap that is easily coupled to/decoupled from the container without compromising the seal that is needed to prevent the cosmetic product from leaking or loosing moisture content while the cosmetic applicator is not being used.

SUMMARY

Aspects and advantages of embodiments of the present disclosure will be set forth in part in the following description, or may be learned from the description, or may be learned through practice of the embodiments.

In one aspect, a cosmetic applicator includes a container configured to accommodate a cosmetic product. The cosmetic applicator includes a cap removably coupled to the container. The container or the cap includes an end configured to apply the cosmetic product. The cosmetic applicator includes a seal radially compressed between the cap and the container. The cosmetic applicator includes a mechanical advantage device having a first portion disposed on the cap and a second portion disposed on the container. The mechanical advantage device is operable to advance a retaining feature attached to the cap or the container across the seal.

In another aspect, a cosmetic applicator includes a container configured to accommodate a cosmetic product and a cap removably disposed on the container. The container or the cap includes an end configured to apply the cosmetic product. The cosmetic applicator includes a seal and a projection extending between the cap and the container. The seal is radially compressed between the cap and the container. The cosmetic applicator includes a mechanical advantage device having complimentary portions disposed on the cap and the container. The mechanical advantage device is operable to advance the projection across the seal when the cap is rotated relative to the container.

In yet another aspect a method for sealing a cosmetic applicator includes: disposing a cap on a container; rotating the cap relative to the container, the rotation axially advancing a retaining feature across a seal disposed between the cap and the container; and radially compressing the seal between the cap and the container.

The following description and the related drawings set forth in detail certain illustrative features of one or more embodiments.

BRIEF DESCRIPTION OF THE DRAWINGS

The appended figures depict certain aspects of the one or more embodiments and are therefore not to be considered limiting of the scope of this disclosure.

Figure 1:
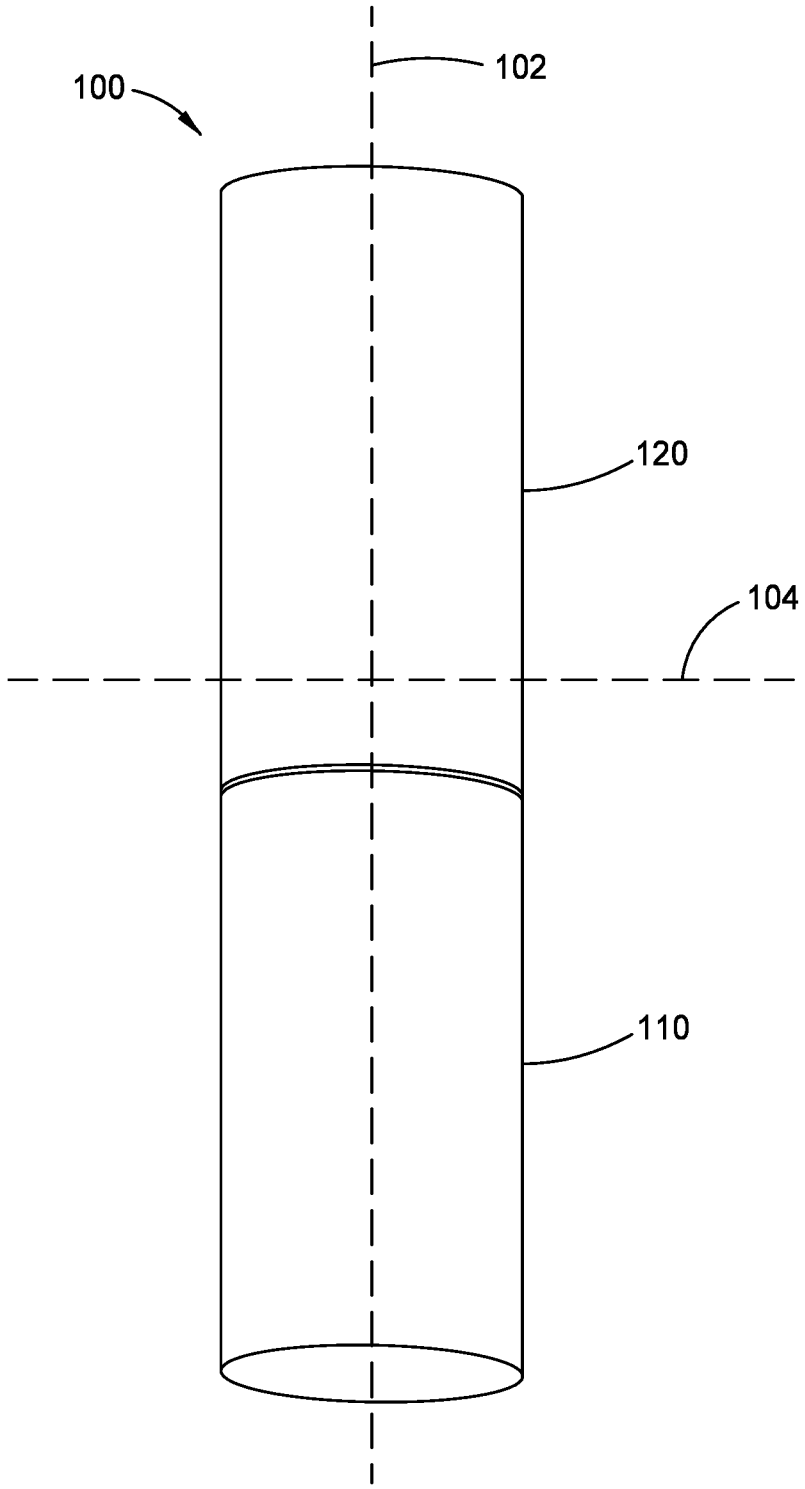
FIG. 1 depicts a cosmetic applicator with a cap according to some embodiments of the present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Throughout this specification, the terms "comprise," "comprises," "comprising" and the like, shall consistently mean that a collection of objects is not limited to those objects specifically recited.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variations that fall within the scope of the appended claims.

Example aspects of the present disclosure are directed to a cosmetic applicator. The cosmetic applicator includes a container and a removable cap. The container may accommodate a cosmetic product. The container or the cap may include an end configured to apply (e.g., directly) the cosmetic product to a user. The removable cap may be coupled to the container when the cosmetic applicator is not in use (e.g., not being used to apply the cosmetic product) and decoupled (e.g., separated) from the container when the cosmetic applicator is in use.

The cosmetic applicator includes a seal disposed between the cap and the container. The seal may be radially compressed to provide an airtight seal between the container and the removable cap. In this manner, the seal may prevent the cosmetic product from leaking or loosing moisture content while the cosmetic applicator is not in use.

The cosmetic applicator may include a mechanical advantage device for moving the removable cap axially relative to the container or vice versa. The mechanical advantage device may include a first portion disposed on the container and a second portion disposed on the removable cap. In some embodiments, one of the first portion of the mechanical advantage device and the second portion of the mechanical advantage device includes a thread form while the other portion includes a projection that engages the thread form to facilitate displacement of the removable cap relative to the container. For instance, the threads on the second portion of the mechanical advantage device may engage (e.g., mate with) the corresponding threads on the first portion of the mechanical advantage device or vice versa.

The mechanical advantage device is operable to advance a retaining feature attached to the cap or the container across the seal so that less force is needed to decouple (e.g., separate) the removable cap from the container. It should be noted that the mechanical advantage device does not apply force needed to compress the seal for the purpose of creating a seal, but rather provides a force to traverse the seal when removing or replacing the cap on the container. For example, the retaining feature is positioned below the seal when the removable cap is secured to the container via the mechanical advantage device. As a user rotates the removable cap relative to the container, the second portion of the mechanical advantage device interacts with the first portion of the mechanical advantage device to displace the removable cap axially relative to the container so that the retaining feature is advanced across the seal without the user having to exert a force in the axial direction. As the mechanical advantage device moves the retaining feature to the opposite side of the seal, a force with which the user needs to pull the removable cap to decouple (e.g., separate) the removable cap from the container is significantly reduced compared to a force with which the user needs to pull off the removable cap from conventional cosmetic applicators.

Figure 2:
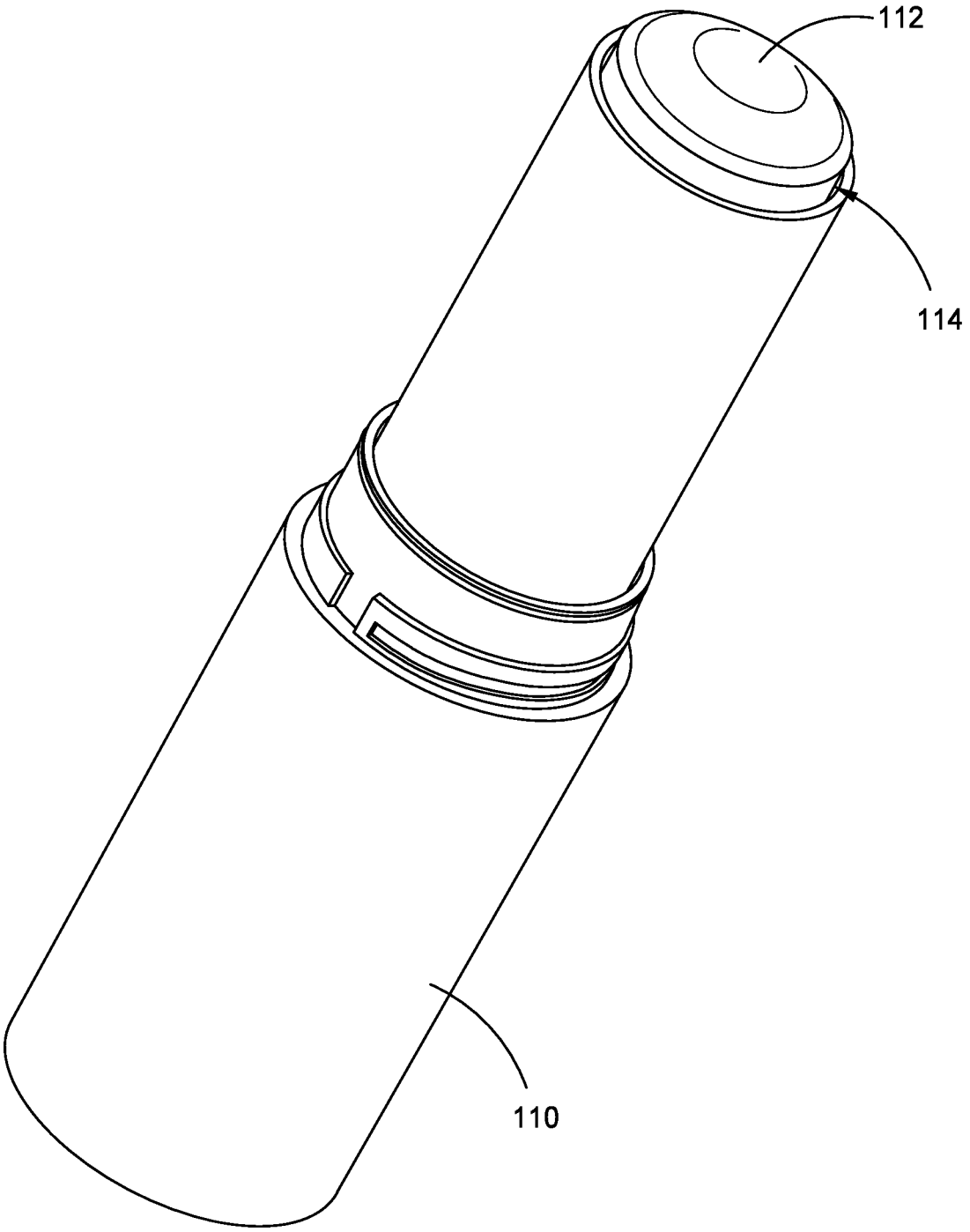
FIG. 2 depicts a cosmetic applicator with a cap thereof removed to expose an end of a container of the cosmetic applicator that is configured to apply a cosmetic product according to some embodiments of the present disclosure.

Referring now to FIGS. 1-2, a cosmetic applicator 100 is provided according to some embodiments of the present disclosure. The cosmetic applicator 100 may define an axial direction 102 and a radial direction 104. It should be appreciated that the axial direction 102 may generally be aligned with a centerline of the cosmetic applicator 100 that is collinear with the elongated axis of the cosmetic applicator 100, as illustrated in FIG. 1.

The cosmetic applicator 100 may include a container 110. The container 110 may accommodate a cosmetic product 112. The container may be a tube, jar, tray, bottle, or other sealable container. In some embodiments, an end of the container 110 may be configured to facilitate accessing the cosmetic product 112 held by the container 110 and/or applying (e.g., directly) the cosmetic product 112 to a user of the cosmetic applicator 100. For example, as shown in FIG. 2, the container 110 may define an opening 114 at an end thereof and the cosmetic product 112 may be positioned within the opening 114. More particularly, the cosmetic product 112 may be positioned within the opening 114 such that a portion of the cosmetic product 112 is exposed when the removable cap 120 is decoupled from the container 110.

Although the container 110 is depicted as defining the opening 114 at an end thereof to facilitate applying the cosmetic product 112 to the user of the cosmetic applicator 100, it should be appreciated that the container 100 may be configured in any suitable manner to facilitate applying the cosmetic product 112. For example, the container 110 may include an end configured as a pen, a pencil, a brush, a pad, a sponge, a tubes, or a flock, among others, to facilitate applying (e.g., directly) the cosmetic product 112 to a user of the cosmetic applicator 100.

The cosmetic applicator 100 includes a removable cap 120. When the cosmetic applicator 100 is not in use (e.g., not being used to apply the cosmetic product), the removable cap 120 may be coupled to the container 110 as shown in FIG. 1. Conversely, the removable cap 120 may be decoupled from (e.g., separated) the container 110 when the cosmetic applicator 100 is in use (e.g., being used to apply the cosmetic product) to expose the applicator 112, as shown in FIG. 2.

Figure 7C:
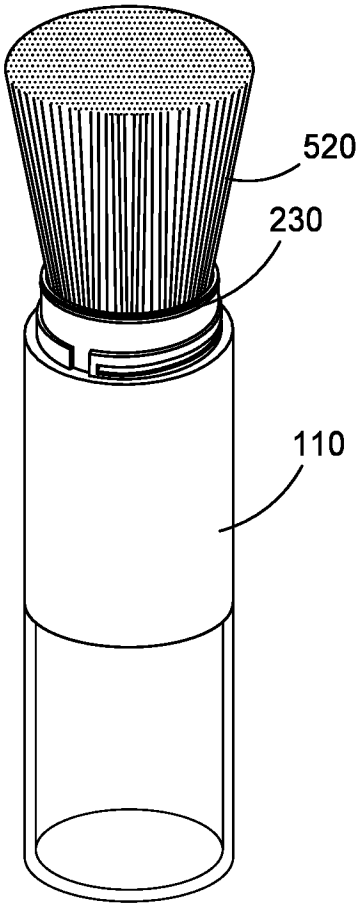
FIG. 7C depicts yet another container of a cosmetic applicator having an end configured to apply a cosmetic product according to some embodiments of the present disclosure.
Figure 7B:
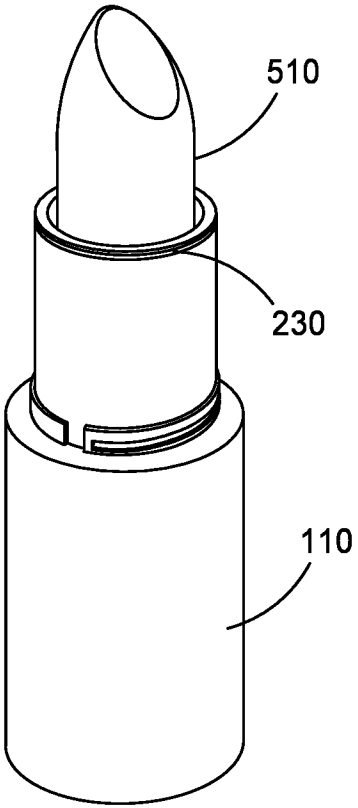
FIG. 7B depicts a container of a cosmetic applicator having an end configured to apply a cosmetic product according to some embodiments of the present disclosure.
Figure 7A:
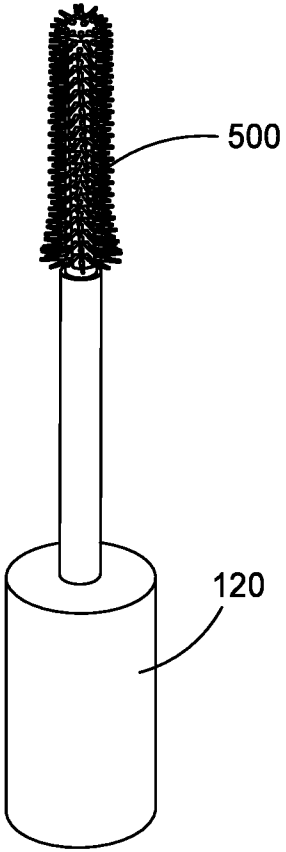
FIG. 7A depicts a removable cap of a cosmetic applicator having an end configured to apply a cosmetic product according to some embodiments of the present disclosure.

Although the container 110 is depicted as being configured to facilitate applying (e.g., directly) the cosmetic product 112 to a user of the cosmetic applicator 100, it should be appreciated that the scope of the present disclosure is intended to cover embodiments of the cosmetic applicator 100 in which the removable cap 120 instead of the container 110 is configured to facilitate applying (e.g., directly) the cosmetic product 112 to the user of the cosmetic applicator 100. For example, in some embodiments, the removable cap 120 may include an end configured as a brush to facilitate applying a cosmetic product (e.g., mascara) as illustrated in FIG. 7A.

Figure 3:
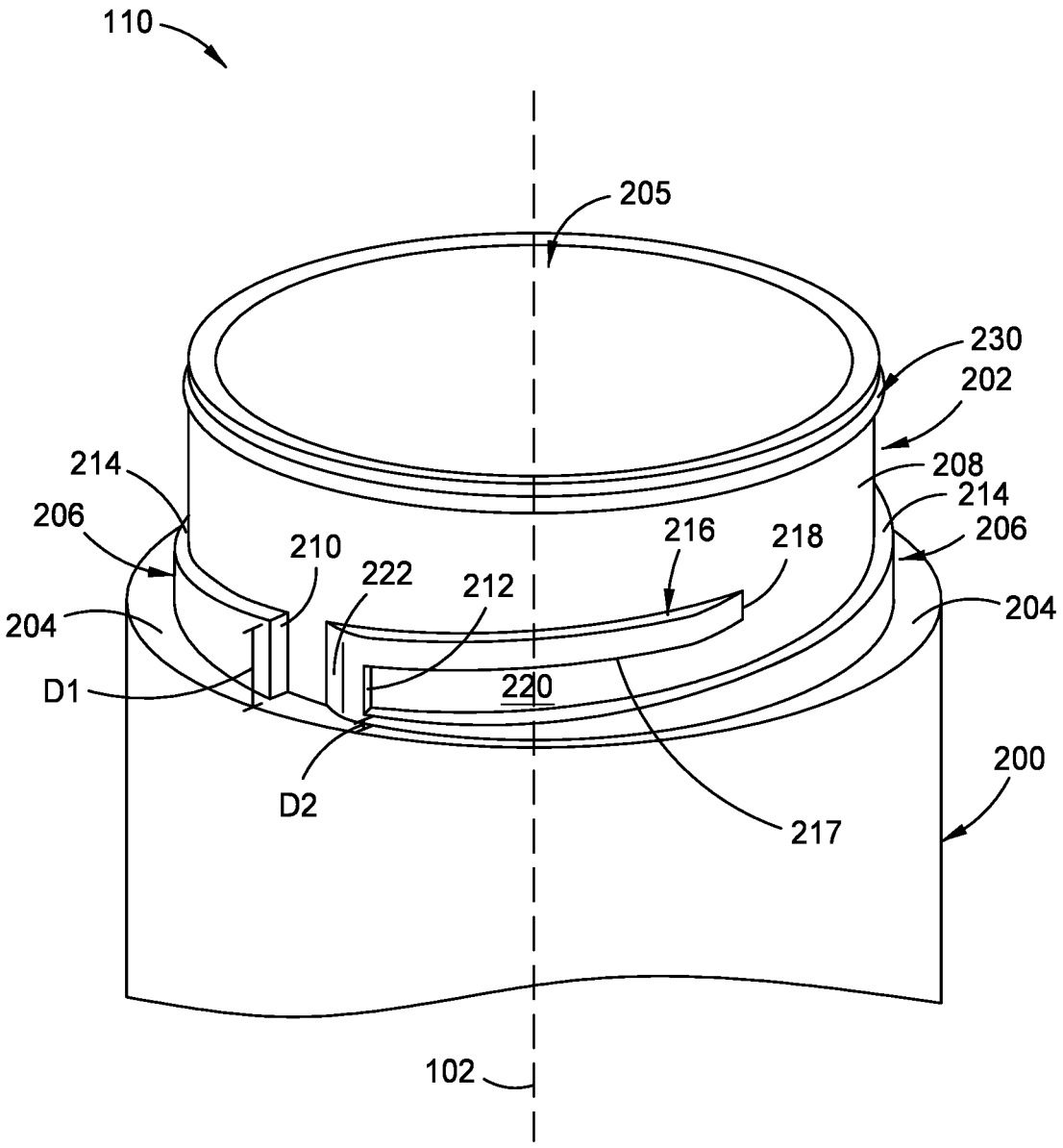
FIG. 3 depicts a portion of a container of a cosmetic applicator according to some embodiments of the present disclosure.

Referring now to FIG. 3, details of the container 110 are illustrated according to some embodiments of the present disclosure. As shown, the container 110 may include a body portion 200 and a neck portion 202. The neck portion 202 may extend (e.g., along the axial direction 102) from a surface 204 of the body portion 200 and may define an opening 205 of the applicator 112 into the interior (e.g., where the cosmetic product is located) of the container 110. In some embodiments, the removable cap 120 (FIG. 1) may couple to the container 110 at the neck portion 202 thereof, and details of the neck portion 202 that facilitate coupling/decoupling of the removable cap 120 from the container 110 thereto will now be discussed.

The neck portion 202 may include a ramp 206. The ramp 206 may be positioned at a base of the neck portion 202 and may project outward (e.g., along the radial direction 104) from an outer surface 208 of the neck portion 202. Furthermore, the ramp 206 may extend (e.g., circumferentially) along the outer surface 208 from a first location 210 thereon to a second location 212 thereon.

It should be appreciated that a height of the ramp 206 at the first location 210 is different (e.g., higher) than a height of the ramp 206 at the second location 212. Stated another way, a first distance D1 (e.g., along the axial direction 102) from the surface 204 of the body portion 200 to a contact surface 214 of the ramp 206 at the first location 210 may be greater than a second distance D2 (e.g., along the axial direction 102) from the surface 204 of the body portion 200 to the contact surface 214 of the ramp 206 at the second location 212.

The neck portion 202 of the container 110 may include a guide member 216 extending (e.g., along the radial direction 104) from the outer surface 208 of the neck portion 202 and positioned (e.g., along the axial direction 102) between the ramp 206 and an end of the neck portion 202 that is distal to the surface 204 on the body portion 200 from which the neck portion 202 extends (e.g., along the axial direction 102). Furthermore, the guide member 216 may start at a third location 218 on the outer surface 208 that is positioned between the first location 210 and the second location 212. The guide member 216 may extend (e.g., circumferentially) along the outer surface 208 of the neck portion 202 to the second location 212 thereon.

As shown, a channel 220 may be defined between the guide member 216 and the ramp 206. More specifically, the channel 220 may extend (e.g., in the axial direction 102 and circumferentially) from the second location 212 on the outer surface 208 of the neck portion 202 to the third location 218 on the outer surface 208 of the neck portion 202.

In some embodiments, the neck portion 202 of the container 110 may include an optional stop 222 (e.g., post) located at the end of the ramp 206. The stop 222 may extend outward (e.g., along the radial direction 104) from the outer surface 208 of the neck portion 202 and may extend (e.g., along the axial direction 102) from the ramp 206 to the guide member 216. In this manner, the stop 222 may close off one end of the channel 220.

In some embodiments, the container 110 (e.g., the neck portion 202 thereof) may include threads 217 that, as will be discussed later on in more detail, facilitate securing the removable cap 120 (FIG. 1) to the container 110. For instance, the guide member 216 may include the threads 217. Alternatively, or additionally, the threads 217 may be included on the portion of the ramp 206 that, along with the guide member 216, defines the channel 220.

The cosmetic applicator 100 may include a seal 230 disposed between the container 110 and the removable cap 120. In some embodiments, the seal 230, which radially compress between the inner diameter of the cap and the container, provides a substantially airtight seal to prevent the cosmetic product from leaking or loosing moisture content while the cosmetic applicator 100 is not in use (e.g., the removable cap 120 is attached to the container 110). The seal 230 may be secured to one of the removable cap 120 or the container 110.

In the example depicted in FIG. 3, the seal 230 is disposed in contact with or formed on the neck portion 202 of the container 110. The seal 230 may be positioned at an end of the neck portion 202 that is distal (e.g. furthest from) the surface 204 on the body portion 200 from which the neck portion 202 extends (e.g., along the axial direction 102). The seal 230 may extend (e.g., circumferentially) along the outer surface 208 of the neck portion 202. For instance, in some embodiments, the seal 230 may be a radial seal that extends along the entire perimeter of the neck portion 202.

In some embodiments, the seal 230 may be integrally formed (such as co-molded) with the neck portion 202 of the container 110. In alternative embodiments, the seal 230 (such as an O-ring and the like) may be separate from the container 110. The seal 230 may be formed from a different (e.g., softer durometer) material than a material (e.g., plastic, metal, etc.) from which the container 110 is formed. In this manner, the seal 230 may be formed from a material that is needed to achieve the substantially airtight seal between the container 110 and the removable cap 120. In some embodiments, the seal 230 may be formed with the removable cap 120.

Figure 4:
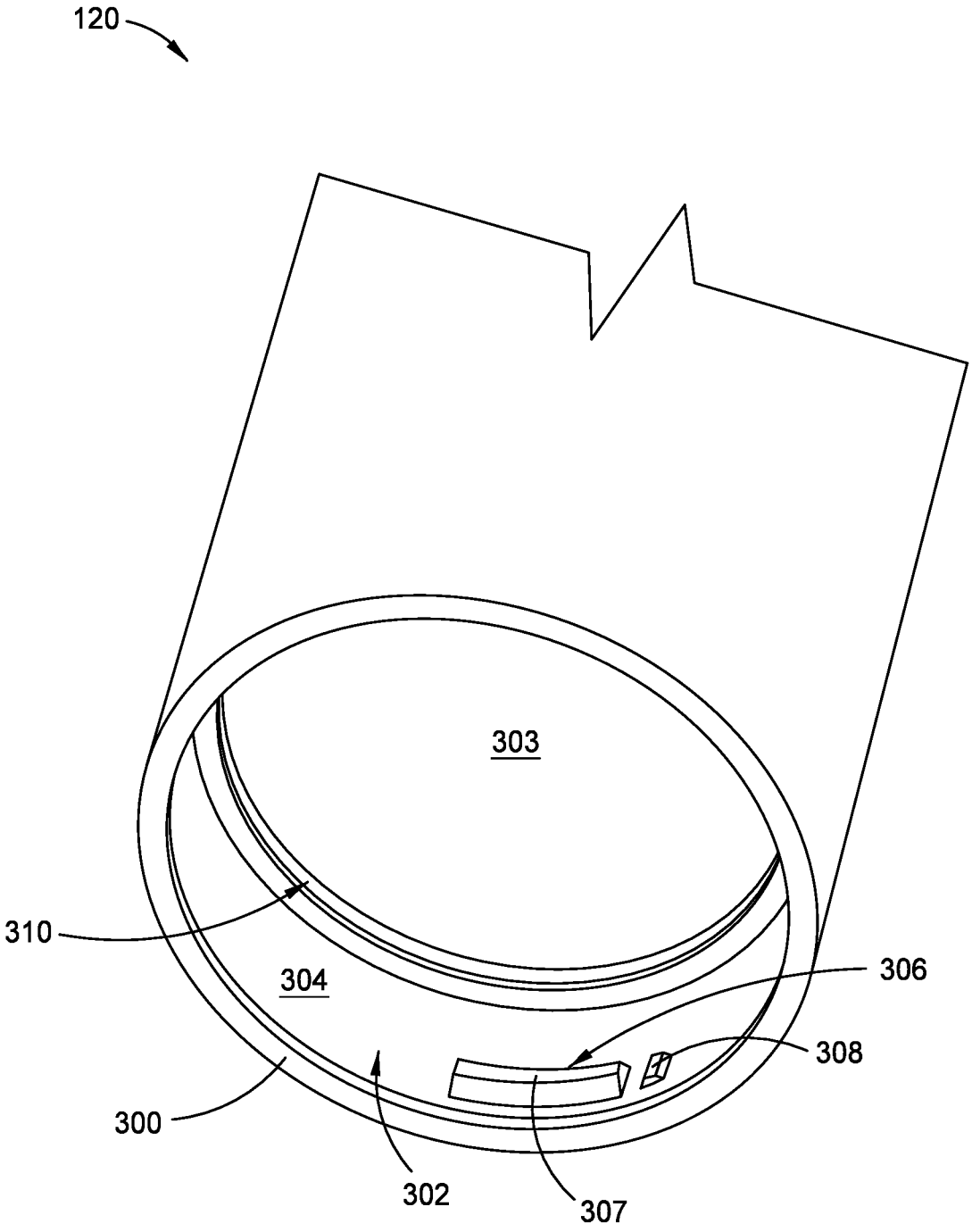
FIG. 4 depicts a portion of a cap of a cosmetic applicator according to some embodiments of the present disclosure.

Referring now to FIG. 4, a bottom view of the removable cap 120 is provided according to some embodiments of the present disclosure. As shown, an end 300 of the removable cap 120 that seats on the body portion 200 (FIG. 3) of the container 110 (FIG. 3) defines an opening 302 into an interior 303 of the removable cap 120. Furthermore, an interior surface 304 of the removable cap 120 may include a post 306 extending (e.g., radially and circumferentially) from the interior surface 304 of the removable cap 120. In some embodiments, the post 306 may include threads 307 configured to engage the threads 217 located on the container 110 (FIG. 3) to secure the removable cap 120 to the container 110. For example, in some embodiments, the threads 307 on the post 306 of the removable cap 120 may engage the threads 217 (FIG. 3) on the container 110 when the post 306 enters the channel 220 (FIG. 3) defined on the container 110.

In some embodiments, the removable cap 120 may include a stop 308 extending (e.g., radially and circumferentially) from the interior surface 304 of the removable cap 120. The stop 308 may act to prevent further rotation of the removable cap 120 in a direction (e.g., clockwise) a user rotated the removable cap 120 to secure the removable cap 120 to the container 110 (FIG. 3). For example, the stop 308 may prevent the user from continuing to rotate the removable cap 120 in the direction (e.g., clockwise) once the post 306 of the removable cap 120 contacts (e.g., touches) the stop 222 (FIG. 3) on the container 110 that, as discussed above, closes off one end of the channel 220.

In some embodiments, the stop 308 on the removable cap 120 may be spaced apart (e.g., along a circumferential direction) from the post 306 by at least a distance corresponding to a width of the stop 222 (FIG. 3) on the neck portion 202 (FIG. 3) of the container 110 (FIG. 3). In this manner, the stop 308 on the removable cap 120 may move (e.g., slide) out of the channel 220 (FIG. 3) and over the stop 222 on the neck portion 202 of the container 110 so that the stop 308 on the removable cap 120 is positioned on the other side of the stop 222 when the post 306 on the removable cap 120 contacts the stop 222 on the neck portion 202 of the container 110. It should be appreciated that the stop 308 on the removable cap 120 may again move over the stop 222 on the neck portion 202 of the container 110 and re-enter the channel 220 as the removable cap 120 is rotated relative to the container 110 so that the post 306 moves towards the exit of the channel 220 (FIG. 3).

As shown, the interior surface 304 of the removable cap 120 may include a retaining feature 310. For instance, in some embodiments, the retaining feature 310 may include a projection that extends (e.g., radially inward) from the interior surface 304. In some embodiments, the retaining feature 310 may extend (e.g., circumferentially) along at least a portion of the interior surface 304 of the removable cap 120. For instance, in some embodiments, the retaining feature 310 may be an annular projection that extends along the entire circumference of the removable cap 120. In alternative embodiments, the retaining feature 310 may be broken into multiple projections. For example, the retaining feature 310 may include a first projection extending along a first portion of the interior surface 304 and a second projection extending along a second portion of the interior surface 304 that does not overlap with the first portion of the interior surface 304.

In some embodiments, the retaining feature 310 may include one or more detents as opposed to annular projections as shown in FIG. 4. In such embodiments, the detent may be a localized projection that extends (e.g., radially inward) from the interior surface 304. As will be now be discussed, the retaining feature 310 may traverse (e.g., move across) the seal 230 (FIG. 3) on the container 110 as a user rotates the removable cap 120 relative to the container 110.

Figure 5:
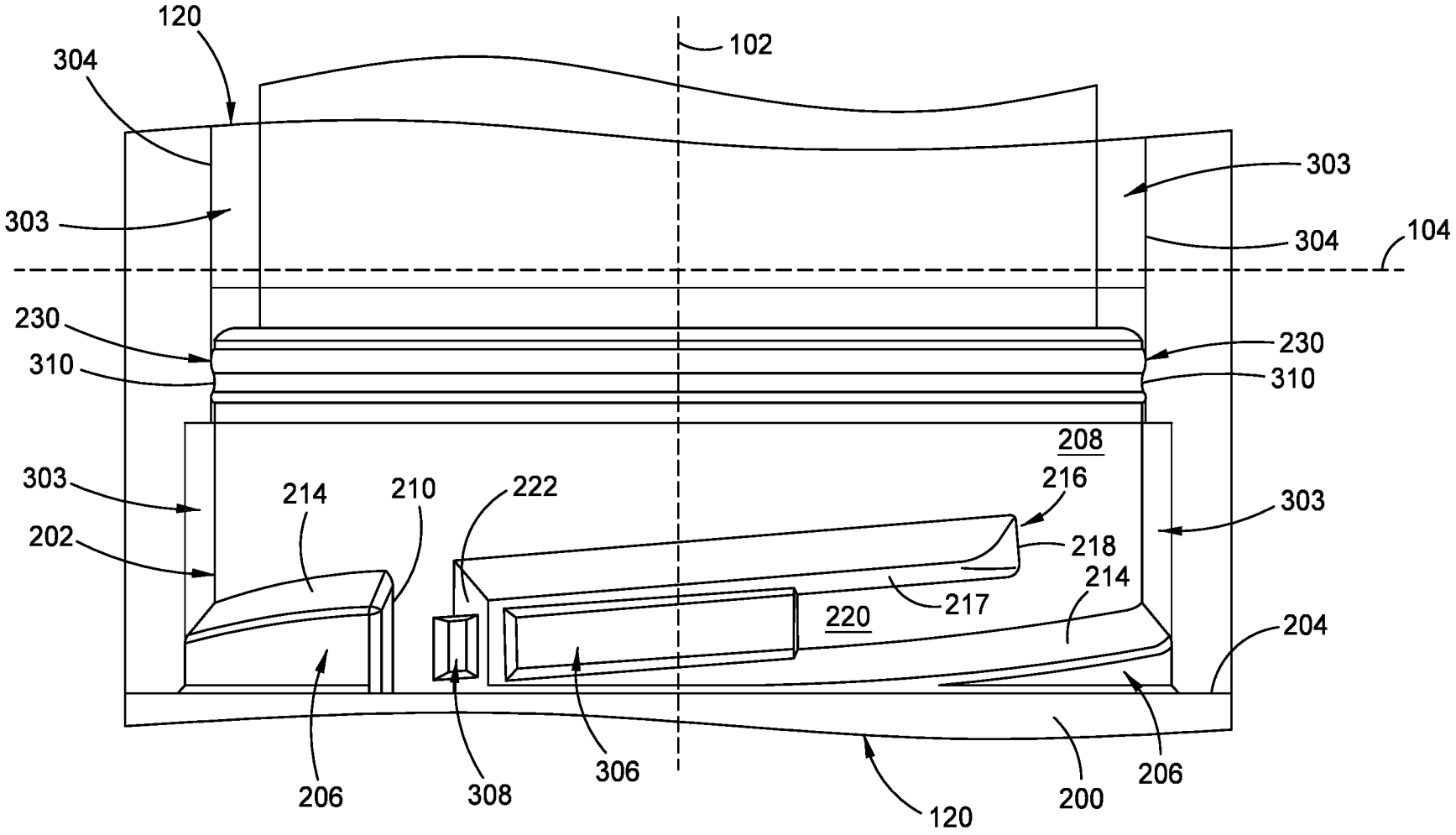
FIG. 5 depicts a cap of a cosmetic applicator secured to a container of the cosmetic applicator according to some embodiments of the present disclosure.

Referring now to FIG. 5, the removable cap 120 may seat on the container 110, specifically the body portion 200 thereof, such that the applicator 112 (FIG. 2) is positioned within the interior 303 of the removable cap 120 and the seal 230 is radially compressed between the outer surface 208 of the container 110 and the interior surface 304 of the removable cap 120. Also, the post 306 on the removable cap 120 may be positioned within the channel 220 defined on the container 110 such that the threads 307 on the post 306 of the removable cap 120 engage the threads 217 on the container 110 to secure the removable cap 120 to the container 110.

Also, in some embodiments, the stop 308 on the removable cap 120 may be positioned as shown to prevent further rotation of the removable cap 120 in the direction (e.g., clockwise) in which the removable cap 120 was rotated to secure the removable cap 120 to the container 110. More specifically, the stop 308 may be positioned (e.g., along a circumferential direction) along the outer surface 208 of the neck portion 202 of the container 110 so that the stop 308 is positioned between the stop 222 on the container 110 and a portion of the ramp 206, such as the portion of the ramp 206 at the first location 210 on the outer surface 208 of the neck portion 202 of the container 110.

To remove the removable cap 120, a user may rotate (e.g., counterclockwise) the removable cap 120 relative to the container 110. As the user rotates the removable cap 120 relative to the container 110, the post 306 located on the removable cap 120 may exit the channel 220 defined on the container 110. In this manner, the threads 307 (FIG. 4) on the post 306 may disengage from the threads 217 on the container 110.

When the post 306 on the removable cap 120 exits the channel 220 on the container 110, the retaining feature 310 on the removable cap 120 traverses the seal 230 along the axial direction 102 so that the removable cap 120 is easier to decouple (e.g., separate) from the container 110. In this manner, a force with which the user needs to pull the removable cap 120 to decouple (e.g., separate) the removable cap 120 from the container 110 will be reduced.

It should be appreciated that the operation discussed above with reference to removing the removable cap 120 may occur in reverse when the removable cap 120 is being rotated (e.g., clockwise) relative to the container 110 to advance the retaining feature 310 back across the seal 230. For example, the retaining feature 310 on the interior surface 304 of the removable cap 120 may move back across the seal 230 along the axial direction 102 as the post 306 on the removable cap 120 re-enters the channel 220 and, as a result, the threads 307 (FIG. 4) of the post 306 reengage the threads 217 on the container 110 to again secure the removable cap 120 to the container 110.

Figure 6A:
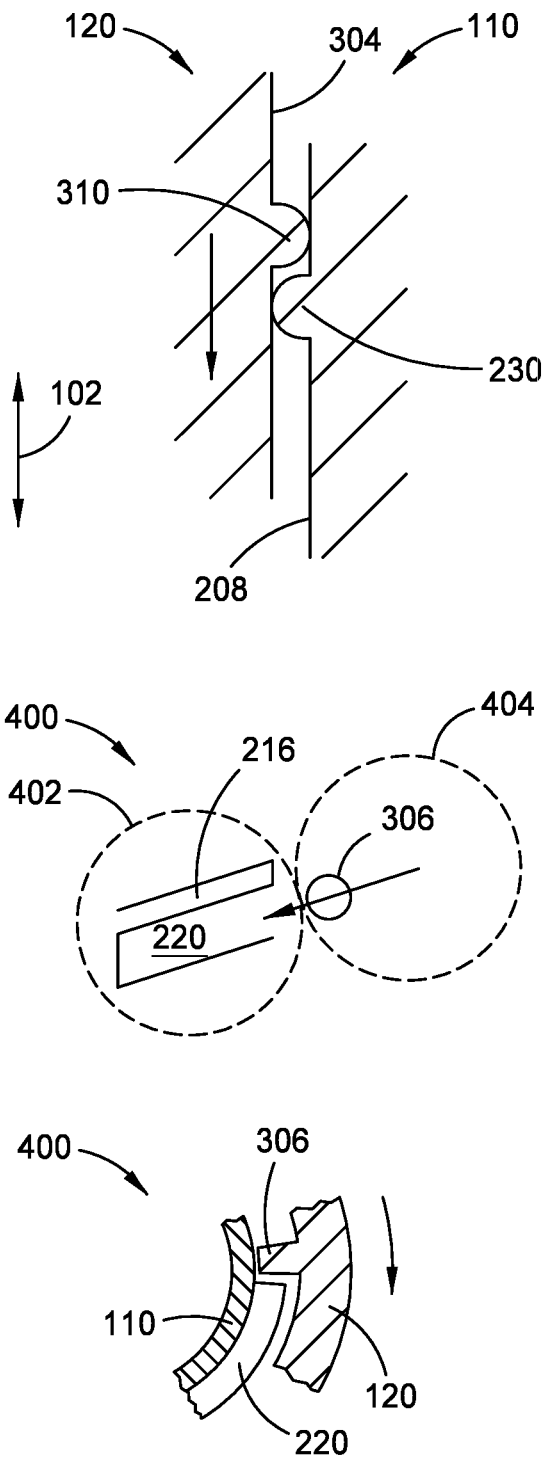
FIGS. 6A and 6B includes different schematic partial views of the cap engaging the container across a seal according to some embodiments of the present disclosure.
Figure 6B:
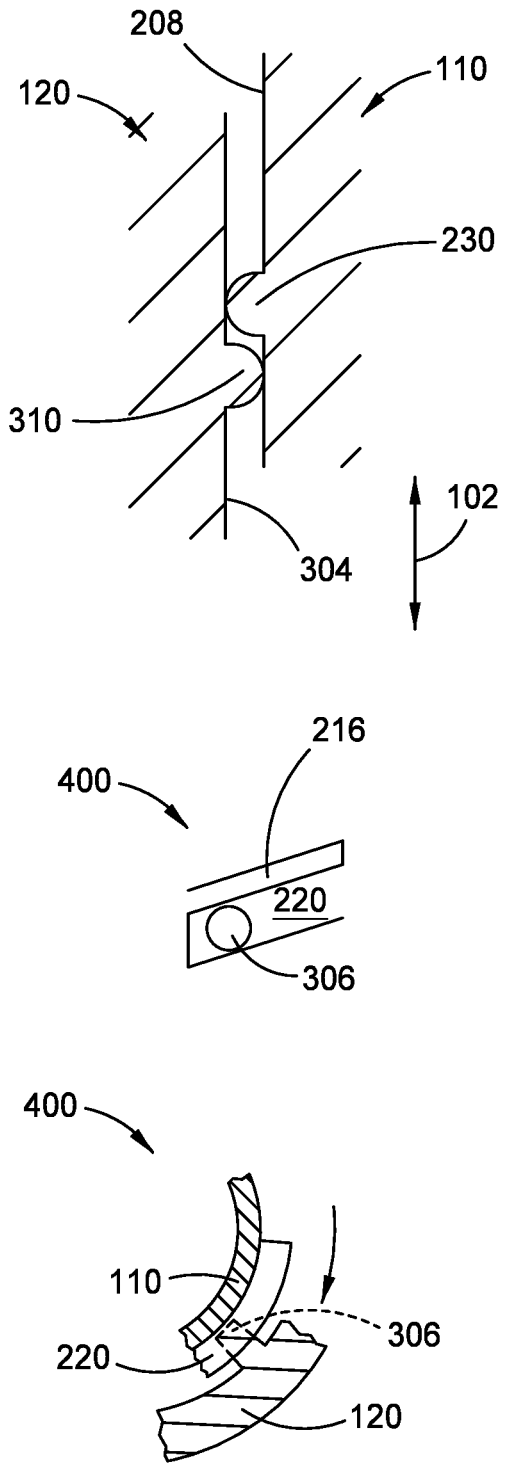

Referring now to FIGS. 6A and 6B, a mechanical advantage device 400 operable to move (e.g., along the axial direction 102) the retaining feature 310 so that the retaining feature 310 traverses (e.g., moves across) the seal 230 is depicted according to some embodiments of the present disclosure. The mechanical advantage device 400 may include a first portion 402 on the container 110 and a second portion 404 on the removable cap 120. In some embodiments, the first portion 402 on the container 110 may include the guide member 216 defining the channel 220 discussed above with reference to FIG. 3. Alternatively, or additionally, the second portion 404 on the removable cap 120 may include the post 306 discussed above with reference to FIG. 4. It should be appreciated, however, that the mechanical advantage device 400 may include any suitable mechanical device for securing the removable cap 120 to the container 110.

FIG. 6A illustrates the position (middle and bottom portion of FIG. 6A) of the second portion 404 of the mechanical advantage device 400 relative to the first portion 402 of the mechanical advantage device 400 when the retaining feature 310 of the removable cap 120 is positioned above (top portion of FIG. 6A) the seal 230 along the axial direction 102. Conversely, FIG. 6B illustrates the position (middle and bottom portion of FIG. 6B) of the second portion 404 of the mechanical advantage device 400 relative to the first portion 402 of the mechanical advantage device 400 when the retaining feature 310 is positioned below (top portion of FIG. 6B) the seal 230 along the axial direction 102.

The second portion 404 of the mechanical advantage device 400 may be disengaged from the first portion 402 of the mechanical advantage device 400 when the retaining feature 310 of the removable cap 120 is positioned above (top portion of FIG. 6A) the seal 230 along the axial direction 102. For example, the post 306 (e.g., second portion 404 of the mechanical advantage device 400) of the removable cap 120 may be positioned outside of the channel 220 defined by the guide member 216 (e.g., first portion 402 of the mechanical advantage device 400). In this manner, the threads 307 (FIG. 4) of the post 306 on the removable cap 120 are not engaged with the threads 217 (FIG. 3) on the container 110 (e.g., the guide member 216 thereof).

The second portion 404 of the mechanical advantage device 400 may be engaged with the first portion 402 of the mechanical advantage device 400 when the retaining feature 310 of the removable cap 120 is positioned below (top portion of FIG. 6B) the seal 230 along the axial direction 102. For example, the post 306 (e.g., second portion 404 of the mechanical advantage device 400) of the removable cap 120 may be positioned within the channel 220 defined by the container 110. In this manner, the threads 307 (FIG. 7) of the post 306 may be engaged with the threads 217 (FIG. 3) on the container 110 (e.g., the guide member 216 thereof).

In some embodiments, the mechanical advantage device 400 is operable to advance the retaining feature 310 across the seal 230 with less than a full rotation (e.g., 360 degrees) of the removable cap 120 relative to the container 110. For example, the mechanical advantage device 400 may advance the retaining feature 310 across the seal 230 with a half-rotation (e.g., 180 degrees) of the removable cap 120 relative to the container 110.

Although the above embodiments discussed the retaining feature 310 as being part of the removable cap 120, it should be appreciated that the scope of the present disclosure is intended to cover embodiments of the cosmetic applicator 100 (FIG. 1) in which the is located on the container 110 instead of the removable cap 120.

Although the end of the container 110 discussed above with reference to FIG. 2 is depicted as defining an opening 114 in which the cosmetic product 112 is positioned, it should be appreciated that the scope of the present disclosure is not limited to the embodiment of the cosmetic applicator 100 depicted in FIG. 2. Examples of different ends of the container 110 and the removable cap 120 are depicted in FIGS. 7A-7C and are not intended to be an exhaustive list of ways in which these ends may be configured to facilitate applying (e.g., directly) a cosmetic product according to example aspects of the present disclosure. FIG. 7A illustrates an end of the removable cap 120 configured as a brush applicator 500 that may be used to apply a cosmetic product, such as mascara. FIG. 7B illustrates an end of the container 110 configured as a lipstick applicator 510. FIG. 7C illustrates an end of the container 110 configured as a blush applicator 520.

Figure 8:
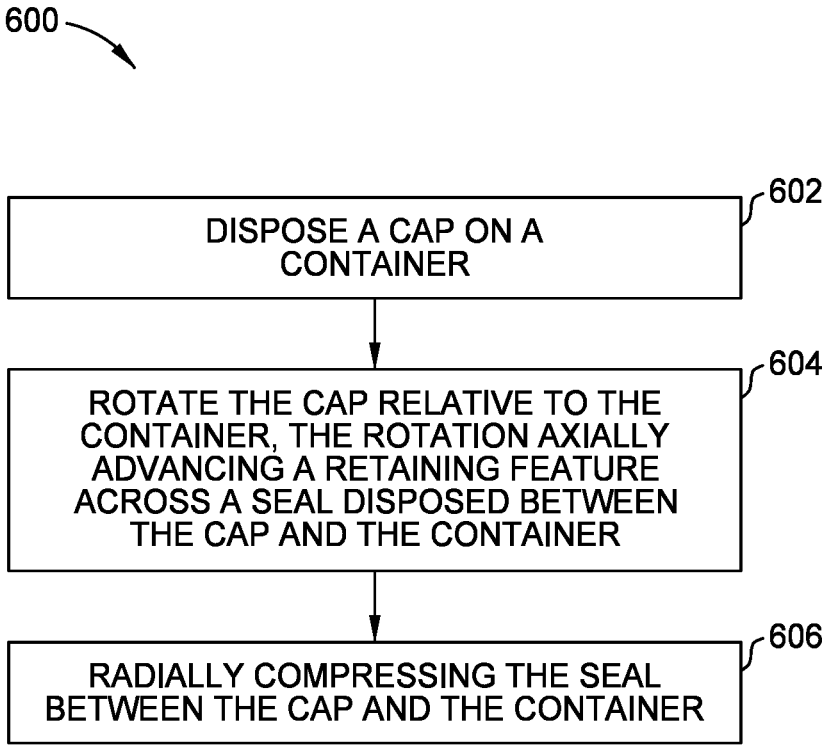
FIG. 8 depicts a method for sealing a cosmetic applicator according to some embodiments of the present disclosure.

FIG. 8 depicts a method 600 for sealing a cosmetic applicator according to some embodiments of the present disclosure. The method may be implemented using the cosmetic applicator 100 discussed above with reference to FIGS. 1-7A-7C.

Operation 602 includes disposing a cap (such as the removable cap 120 of FIG. 1) of the cosmetic applicator on a container (such as the container 110 of FIG. 1) of the cosmetic applicator.

Operation 604 includes rotating the cap of the cosmetic applicator relative to the container of the cosmetic applicator. For example, the rotation of the cap may be rotated relative to the container to axially advance a retaining feature of the cosmetic applicator across a seal of the cosmetic applicator that is disposed between the cap and the container.

Operation 606 includes radially compressing the seal between the cap and the container.

The above disclosed subject matter is to be considered illustrative, and not restrictive, and the appended claims are intended to cover all such modifications, enhancements, and other aspects which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A cosmetic applicator comprising:

a container configured to accommodate a cosmetic product;

a cap removably coupled to the container;

an end of the cap or the container being configured to apply and/or allow access to the cosmetic product;

a seal radially compressed between the cap and the container; and a mechanical advantage device having a first portion disposed on the cap and a second portion disposed on the container, the mechanical advantage device operable to advance a retaining feature attached to the cap or the container across the seal.

2. The cosmetic applicator of claim 1, wherein:

the first portion of the mechanical advantage device that is disposed on the cap comprises one or more threads; and the second portion of the mechanical advantage device that is disposed on the container comprises one or more corresponding threads configured to engage the one or more threads on the cap.

3. The cosmetic applicator of claim 2, wherein the one or more threads on the cap engaging or disengaging the one or more corresponding threads on the container advances the retaining feature across the seal.

4. The cosmetic applicator of claim 1, wherein the container comprises a body portion and a neck portion extending from a surface of the body portion, the neck portion comprising:

a ramp extending along an outer surface of the neck portion; and the second portion of the mechanical advantage device, the second portion spaced apart from the ramp along an axial direction such that a channel is defined between the ramp and the second portion of the mechanical advantage device.

5. The cosmetic applicator of claim 4, wherein the neck portion further comprises a stop extending from the second portion of the mechanical advantage device to the ramp along the axial direction to close off an end of the channel.

6. The cosmetic applicator of claim 4, wherein the first portion of the mechanical advantage device that is disposed on the cap comprises a post that is movable into and out of the channel with rotation of the cap relative to the container.

7. The cosmetic applicator of claim 6, wherein:

the post enters the channel with rotation of the cap relative to the container in a first direction; and the post exits the channel with rotation of the cap relative to the container in a second direction that is opposite the first direction.

8. The cosmetic applicator of claim 6, wherein the post moves along a contact surface of the ramp with rotation of the cap relative to the container.

9. The cosmetic applicator of claim 6, wherein:

the post entering the channel advances the retaining feature across the seal in a first direction; and the post exiting the channel advances the retaining feature across the seal in a second direction that is opposite the first direction.

10. The cosmetic applicator of claim 9, wherein:

the post comprises one or more threads; and the second portion comprises one or more corresponding threads configured to engage the one or more threads on the post.

11. The cosmetic applicator of claim 1, wherein the retaining feature comprises an annular projection extending from an interior surface of the cap.

12. The cosmetic applicator of claim 1, wherein the seal is integrally formed with the container.

13. The cosmetic applicator of claim 12, wherein:

the container is formed from a first material; and the seal is formed from a second material that is different from the first material.

14. The cosmetic applicator of claim 1, wherein the seal is attached to the container.

15. The cosmetic applicator of claim 1, wherein the end of the cap is configured to apply the cosmetic product.

16. The cosmetic applicator of claim 1, wherein the end of the container is configured to apply the cosmetic product.

17. The cosmetic applicator of claim 16, wherein the end of the container comprises a brush, a lipstick applicator, or a sponge applicator.

18. The cosmetic applicator of claim 1, wherein the mechanical advantage device is operable to advance the retaining feature across the seal with less than a full rotation of the cap relative to the container.

19. A cosmetic applicator comprising:

a container;

a cap removably disposed on the container, the container or the cap having an end configured to apply and/or allow access to a cosmetic product;

a seal and a projection extending between the cap and the container, the seal radially compressed between the cap and the container; and a mechanical advantage device having complimentary portions disposed on the cap and the container, the mechanical advantage device operable to advance the projection across the seal when the cap is rotated relative to the container.

20. The cosmetic applicator of claim 18, wherein at least one of the complimentary portions of the mechanical advantage device is a thread form, and wherein the mechanical advantage device does not compress the seal when the projection traverses the seal.

21. A method for sealing a cosmetic applicator, the method comprising:

disposing a cap on a container;

rotating the cap relative to the container, the rotation axially advancing a retaining feature across a seal disposed between the cap and the container; and radially compressing the seal between the cap and the container.

* * * * *